US008021018B2

(12) United States Patent
Zheng et al.

(10) Patent No.: US 8,021,018 B2
(45) Date of Patent: Sep. 20, 2011

(54) LED DISPLAY PANEL WITH OPENABLE FRONT DOOR

(75) Inventors: Zhongliang Zheng, Hangzhou (CN); Xiaoqing Huang, Hangzhou (CN)

(73) Assignee: Thinksign Optoelectronics, Inc., Binjiang High-Tech Zone, Hangzhou Zhejiang Province (CN)

( * ) Notice: Subject to any disclaimer, the term of this patent is extended or adjusted under 35 U.S.C. 154(b) by 224 days.

(21) Appl. No.: 12/498,352

(22) Filed: Jul. 6, 2009

(65) Prior Publication Data

US 2011/0002129 A1 Jan. 6, 2011

(51) Int. Cl.
*F21S 4/00* (2006.01)
*F21V 21/00* (2006.01)

(52) U.S. Cl. ..... 362/249.03; 362/249.09; 362/371; 362/427; 362/432; 362/800

(58) Field of Classification Search ..... 362/249.02–249.03, 249.09–249.1, 362/371, 418, 427, 432, 800
See application file for complete search history.

(56) References Cited

U.S. PATENT DOCUMENTS 7,344,296 B2 * 3/2008 Matsui et al. ..... 362/652
* cited by examiner

*Primary Examiner* — Jason Moon Han

(57) ABSTRACT

A LED display unit comprises a housing; an openable door coupled to a front of the housing for movement between a closed position and an opened position; a LED module mounted on a front of the openable door; and a sliding assembly coupled to an inside surface of the housing and an inside surface of the front door comprising: a first connection member fixedly mounted to an inside surface of the housing, a second connection member fixedly mounted to an inside surface of the front door, a sliding member slidely mounted to the first connection member and rotatably connected with the second connection member, so that the sliding member can move forward from the housing and rotate relative to the openable door so as to open the openable door.

18 Claims, 5 Drawing Sheets

LED DISPLAY PANEL WITH OPENABLE FRONT DOOR

BACKGROUND OF THE PRESENT INVENTION

1. Field of Invention

The present invention relates to a light emitting diode (LED) display panel, and more particularly to an LED display panel comprising a plurality of LED display units, each display unit having an openable front door that can be slid forward and then rotated so as to be opened, which makes the maintenance easier and safer.

2. Description of Related Arts

Usually, outdoor display panels are combined with a plurality of display units. Each display unit includes a display module, a housing, a back door, a power supply, a control board, wires, a fan, and so on. The display module and other components are installed inside the housing from a back door. When being combined to a large display panel, the plurality of display units have to be connected from a back side thereof.

Such kind of display panel needs a back space for being maintained. However, when there is no back installation space, for example, when the display panel is mounted to a wall, or two display panels are mounted together in a back to back manner, such kind of display panel can not be used.

When there is a back space, the operator can not see the front display panel, while standing at back of the display panel, so that another operator is needed to stand in front of the display penal to tell the situation in the front to the operator in the back, so as to confirm the cause of the faulty and conduct the maintenance. Furthermore, when the display panel is mounted on a high place, it is more inconvenient for the operator to conduct the maintenance for the display panel.

Some companies detach the display unit that needs to be maintained. However, detaching the display unit wastes a lot of time, and each display unit is small, so that the maintenance space is very limited.

Accordingly, a display panel with front door is rapidly developed. One kind of display panel has an overall front door, and has surrounding frame at four sides, so that the display panel can not be combined to form a larger display panel. When display panels of difference sizes are needed, it has to be customized and can not be manufactured according to a single standard, which brings potential problems for delivery date and quality control.

Another example of display panel comprises a plurality of display units connected via a clip spring and chassis. The shortcoming of such kind of display panel is not strong enough to stand during the typhoon and strong vibration.

Another example of display panel adopts a four-link mechanism to open and close the front door. However, by using the four-link mechanism, the front door may shift a little during the opening process, which will cause a collision and interference between the neighboring display units. Furthermore, the position of the front door is not stable relative to the housing, so that the display units can not be precisely combined.

SUMMARY OF THE PRESENT INVENTION

An object of the present invention is to provide an LED display panel comprising a plurality of LED display units, each unit having an openable front door that can be slid forward and then rotated so as to be opened, so that the maintenance can be done at the front of the LED display panel, which makes the maintenance easier and safer.

Another object of the present invention is to provide an LED display unit comprising a sliding assembly that can enable the openable front door to be slid forward and then rotated so as to be opened, and provide stable connection between the openable front door and the housing.

Another object of the present invention is to provide an LED display panel comprising a plurality of LED display units, each unit having an openable front door that can be moved forward and then rotated so as to be opened. However, the opening of one unit will not affect the neighboring units, and the plurality of LED display units can be precisely connected together.

Another object of the present invention is to provide an LED display unit comprising a sliding assembly, wherein high-precision balls are used, so that the openable front door can slide smoothly along the balls.

Another object of the present invention is to provide an LED display unit comprising a sliding assembly, wherein a shaft is used, so that the front door can be rotated to be opened after being pulled away from the housing.

Another object of the present invention is to provide an LED display panel comprising a plurality of LED display units, wherein the plurality of LED display units can be rapidly combined to LED display panels with different resolutions.

Another object of the present invention is to provide an LED display panel comprising a plurality of LED display units, wherein each LED display unit is manufactured according to a predetermined standard, so as to ensure the mass production of the product.

Accordingly, in order to accomplish the above objects, the present invention provides a light emitting diode (LED) display unit comprising:

a housing;

an openable door coupled to a front of the housing for movement between a closed position and an open position;

a light emitting diode (LED) module mounted on a front of the openable door; and a sliding assembly coupled to an inside surface of the housing and an inside surface of the front door comprising:

a first connection member fixedly mounted to an inside surface of the housing, a second connection member fixedly mounted to an inside surface of the front door, a sliding member slidely connected to the first connection member and rotatably connected with the second connection member, so that the sliding member can slide forward from the housing and rotate relative to the openable door so as to open the openable door.

These and other objectives, features, and advantages of the present invention will become apparent from the following detailed description, the accompanying drawings, and the appended claims.

DETAILED DESCRIPTION OF THE PREFERRED EMBODIMENT

Figure 1:
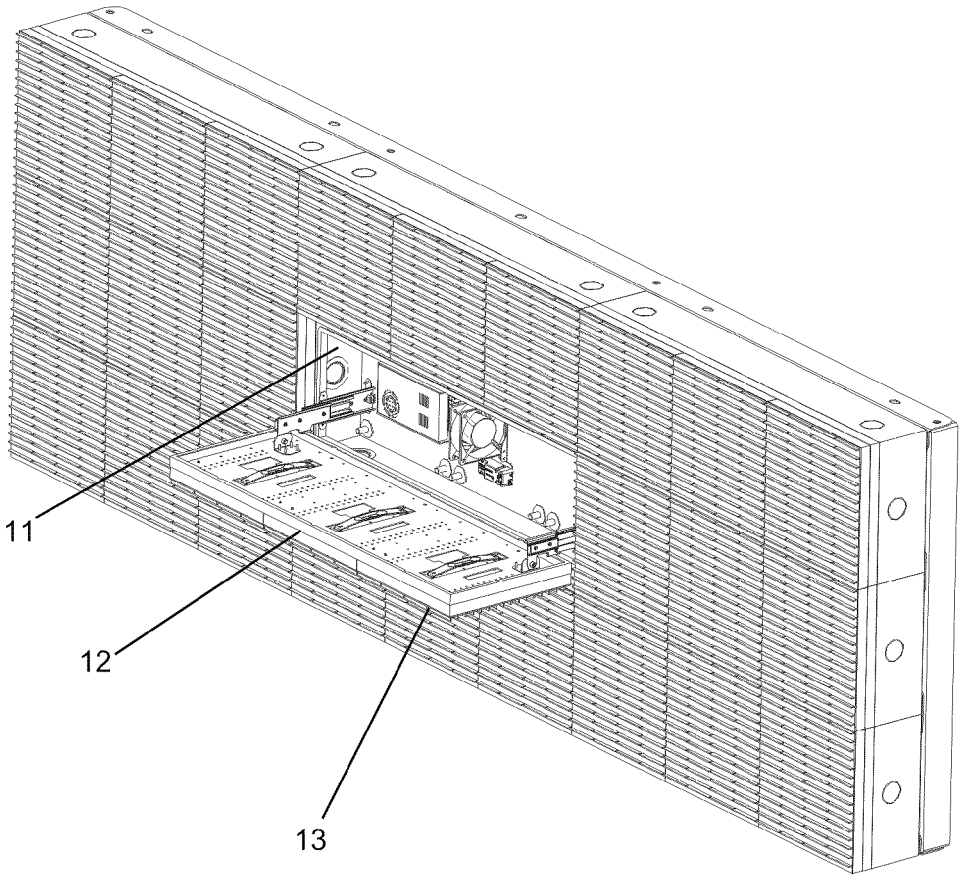
FIG. 1 is a perspective view of an LED display panel comprising a plurality of LED display units according to a preferred embodiment of the present invention.
Figure 2:
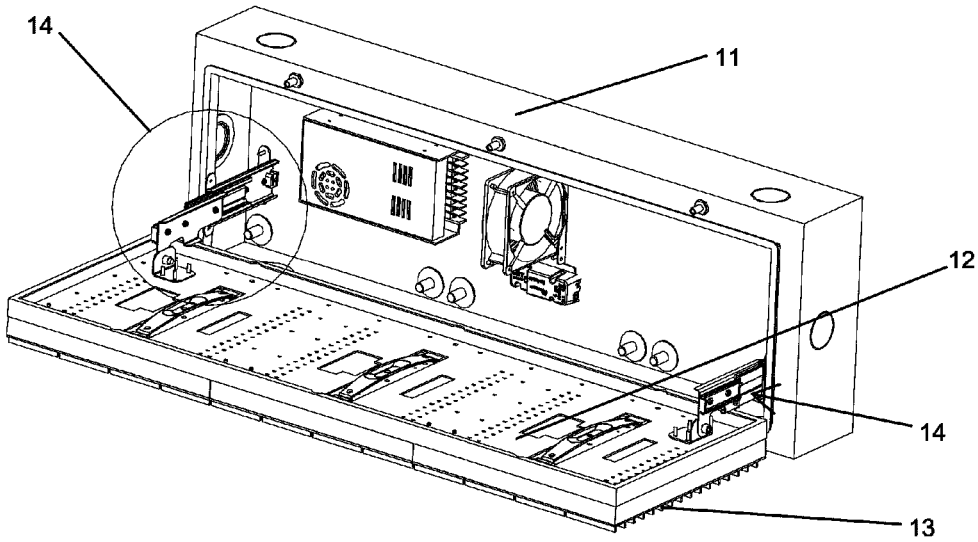
FIG. 2 is a perspective view of an LED display unit according to the above preferred embodiment of the present invention.
Figure 3:
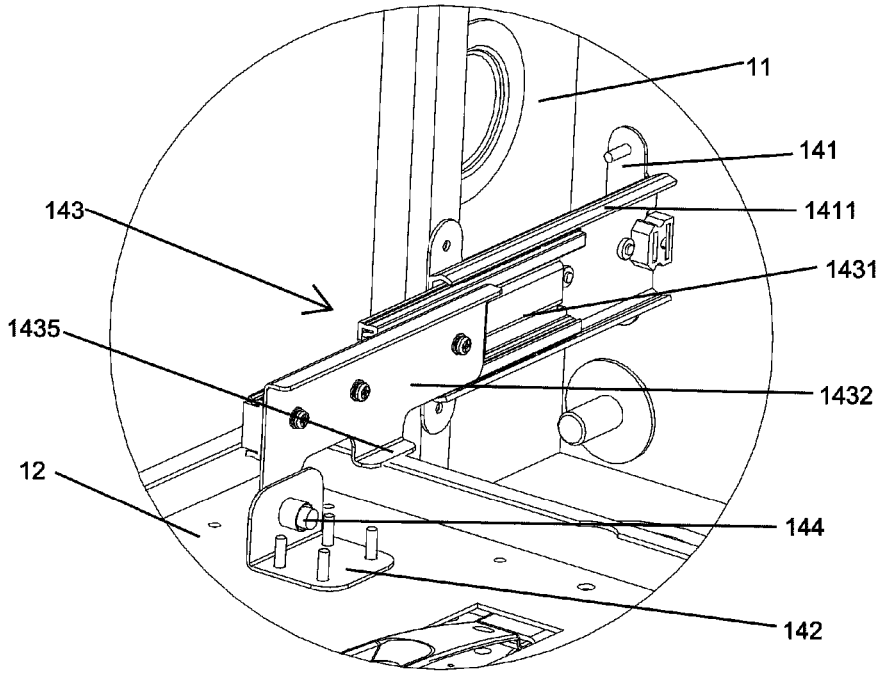
FIG. 3 is an enlarged view of a sliding assembly of an LED display unit according to the above preferred embodiment of the present invention.
Figure 4:
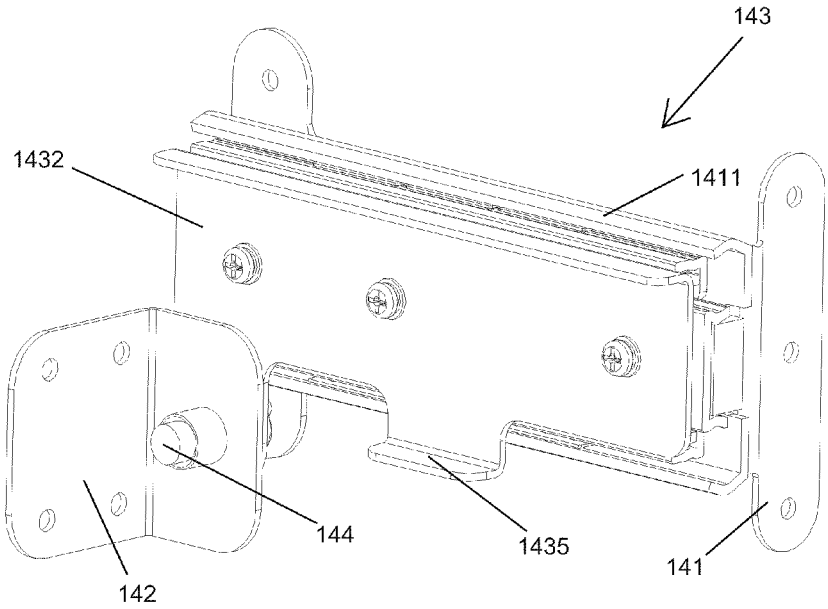
FIG. 4 is a perspective view of a sliding assembly in a closed position according to the above preferred embodiment of the present invention.
Figure 5:
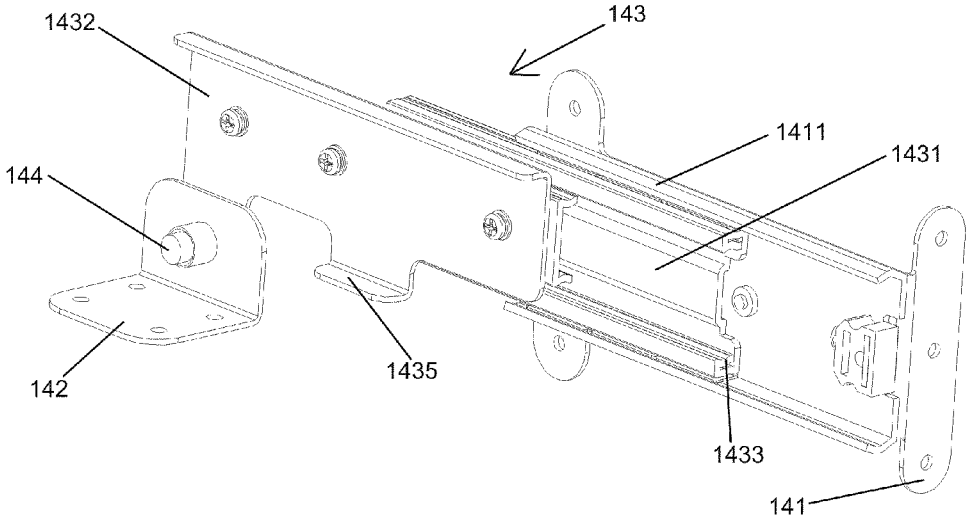
FIG. 5 is a perspective view of a sliding assembly in an open position according to the above preferred embodiment of the present invention.
Figure 6:
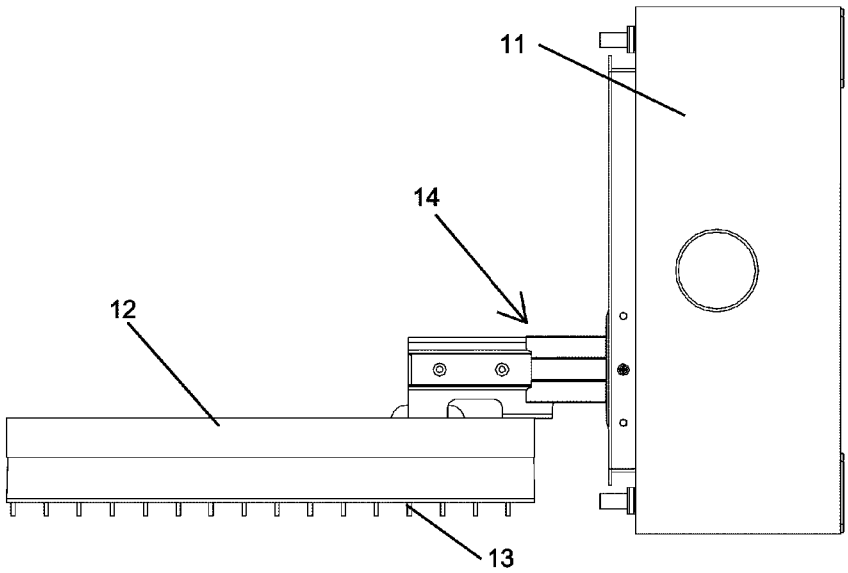
FIG. 6 is a side view of an LED display unit in an open position according to the above preferred embodiment of the present invention.
Figure 7:
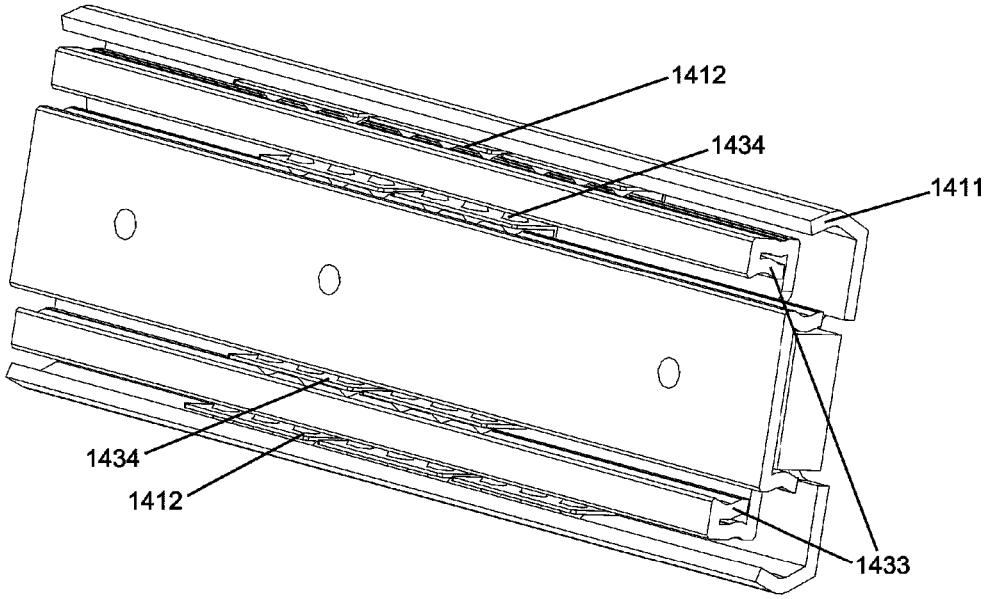
FIG. 7 is a perspective view of a sliding member in a closed position according to the above preferred embodiment of the present invention.
Figure 8:
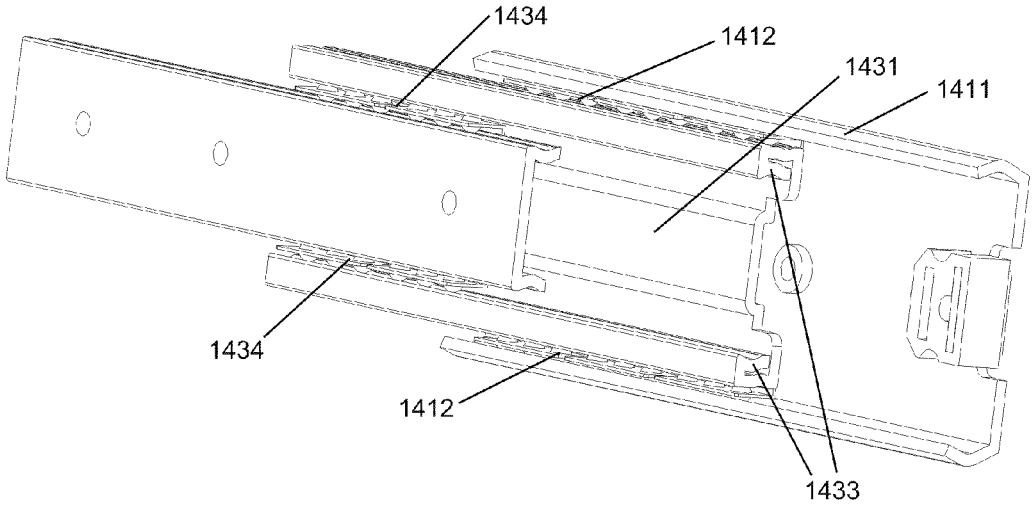
FIG. 8 is a perspective view of a sliding member in an open position according to the above preferred embodiment of the present invention.

Referring to FIG. 1 through FIG. 8 of the drawings, an LED display panel according to a preferred embodiment of the present invention is illustrated, in which the LED display panel comprises a plurality of LED display units 10 connected together forming a larger LED display panel. Each LED display unit comprises a housing 11, an openable door 12 coupled to a front of the housing for movement between a closed position and an open position, an LED module 13 mounted on a front of the openable door, and a sliding assembly 14 coupled between an inside surface of the housing 11 and an inside surface of the front door 12, wherein the sliding assembly 14 can enable the openable door 12 to be slid forward and then rotated so as to be opened.

The LED module 13 is mounted on a front of the openable door 12, so that when the openable door 12 is closed, the LED module 13 can function as normal. When the circuit or other components inside the housing 11 need to be installed or maintained, the operator can open the openable door 12 in front of the housing 11 to access inside of the housing 11, which is easy and safe.

The openable door 12 coupled to the front of the housing 11 can move between a closed position and an open position via the sliding assembly 14, which coupled between the housing 11 and the openable door 12, so that the circuit or other components inside the housing 11 can be accessed by the operator for being installed and maintained easily and safely.

The sliding assembly 14 comprises a first connection member 141 fixedly mounted to an inside surface of the housing 11 by bolts, a second connection member 142 fixedly mounted to an inside surface of the front door 12 by bolts, a sliding member 143 slidely connected with the first connection member 141 and rotatably connected with the second connection member 142, so that the sliding member 143 can slide forward from the housing 11 and rotate relative to the openable door 12 so as to open the openable door 12.

The first connection member 141 is elongated shape having one end fixedly mounted to an inside surface of the housing 11 by bolts and the other end extending outwardly, and has two tracks 1411 respectively provided on both elongated inner edges of the elongated track, each comprising a plurality of balls 1412 aligned along the inner edge of the elongated track for the sliding member 143 to smoothly slide thereon.

The sliding member 143 comprises a first sliding member 1431 engaged between the two tracks 1411 of the first connection member to slide along the first connection member 141 via the tracks 1411, a second sliding member 1432 mounted between both inner edges of the first sliding member 1431, and two rails 1433 engaged between the first sliding member 1431 and the second sliding member 1432 at both sides thereof respectively, so that the second sliding member 1432 can slide along the first sliding member 1431 via the rails 1433. Each rail 1433 comprises two rows of balls 1434 at both sides of the rail 1433 respectively for engaging with the first sliding member 1431 and the second sliding member 1432 respectively, so that the second sliding member 1432 can smoothly slide along the first sliding member 1431.

The second sliding member 1432 is rotatably connected with the second connection member 142, so that the openable door 12 can be opened by being rotated after being pulled away from the housing 11. The second connection member 1432 has one end fixedly connected with the openable door 12, and the other end rotatably connected with the second sliding member 1432. The sliding assembly 14 further comprises a shaft 144 rotatably connecting the second sliding member 1432 and the second connection member 142, so that the second sliding member 1432 and the second connection member 142 can rotate relative to each other around the shaft 144.

The second sliding member 1432 further comprises a positioning device 1435 extending from a side thereof. The positioning device 1435 can retain the second sliding member 1432 on the edge of openable door 12 in connection with the housing 11 to a predetermined extend when being pulled away from the housing 11, so as to keep the front openable door to be further pulled away. In another word, the openable door 12 keeps the second sliding member 1432 from being further pulled away from the housing 11 via the positioning device 1435.

Preferably, the length of the first sliding member 1431 is ranging from 10 cm to 20 cm, and the rotation angle of the openable front door is ranging from 75 to 125 degree.

One skilled in the art will understand that the embodiment of the present invention as shown in the drawings and described above is exemplary only and not intended to be limiting.

It will thus be seen that the objects of the present invention have been fully and effectively accomplished. It embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A light emitting diode (LED) display unit, comprising:

a housing;

an openable door coupled to a front of the housing for movement between a closed position and an open position;

a light emitting diode (LED) module mounted on a front of the openable door; and a sliding assembly coupled between an inside surface of the housing and an inside surface of the openable door, wherein the sliding assembly can enable the openable door to be slid forward and then rotated so as to be opened, wherein the sliding assembly comprises a first connection member fixedly mounted to an inside surface of the housing, a second connection member fixedly mounted to an inside surface of the front door, a sliding member slidely connected with the first connection member and rotatably connected with the second connection member, so that the sliding member can move forward from the housing and rotate relative to the openable door so as to open the openable door.

2. The LED display unit, as recited in claim 1, wherein the first connection member is elongated shape having one end fixedly mounted to an inside surface of the housing and the other end extending outwardly, and has two tracks provided on both elongated inner edges of the first connection member.

3. The LED display unit, as recited in claim 2, wherein each track comprises a plurality of balls aligned along the inner edge of the first connection member for the sliding member to smoothly slide thereon.

4. The LED display unit, as recited in claim 3, wherein the sliding member comprises a first sliding member engaged between the two tracks of the first connection member to slide along the first connection member via the tracks, a second sliding member mounted between both inner edges of the first sliding member, and two rails engaged between the first sliding member and the second sliding member at both sides thereof respectively, so that the second sliding member can slide along the first sliding member via the rails.

5. The LED display unit, as recited in claim 4, wherein each rail comprises two rows of balls at both sides of the rail for engaging with the first sliding member and the second sliding member respectively, so that the second sliding member can slide along the first sliding member.

6. The LED display unit, as recited in claim 5, wherein the sliding assembly further comprises a shaft rotatably connecting the second sliding member and the second connection member, so that the second sliding member and the second connection member can rotate relative to each other around the shaft.

7. The LED display unit, as recited in claim 6, wherein the second sliding member further comprises a positioning device extending from a side thereof for retaining the second sliding member on the openable door to a predetermined extend when being pulled away from the housing.

8. The LED display unit, as recited in claim 7, wherein a length of the first sliding member is ranging from 10 cm to 20 cm.

9. The LED display unit, as recited in claim 8, wherein a rotation angle of the openable front door is ranging from 75 to 125 degree.

10. A light emitting diode (LED) display panel comprising a plurality of display units connected together, each display unit comprising:

a housing;

an openable door coupled to a front of the housing for movement between a closed position and an open position;

a light emitting diode (LED) module mounted on a front of the openable door; and a sliding assembly coupled between an inside surface of the housing and an inside surface of the openable door, wherein the sliding assembly can enable the openable door to be slid forward and then rotated so as to be opened, wherein the sliding assembly comprises a first connection member fixedly mounted to an inside surface of the housing, a second connection member fixedly mounted to an inside surface of the front door, a sliding member slidely connected with the first connection member and rotatably connected with the second connection member, so that the sliding member can move forward from the housing and rotate relative to the openable door so as to open the openable door.

11. The LED display panel, as recited in claim 10, wherein the first connection member is elongated shape having one end fixedly mounted to an inside surface of the housing and the other end extending outwardly, and has two tracks provided on both elongated inner edges of the first connection member.

12. The LED display panel, as recited in claim 11, wherein each track comprises a plurality of balls aligned along the inner edge of the first connection member for the sliding member to smoothly slide thereon.

13. The LED display panel, as recited in claim 12, wherein the sliding member comprises a first sliding member engaged between the two tracks of the first connection member to slide along the first connection member via the tracks, a second sliding member mounted between both inner edges of the first sliding member, and two rails engaged between the first sliding member and the second sliding member at both sides thereof respectively, so that the second sliding member can slide along the first sliding member via the rails.

14. The LED display panel, as recited in claim 13, wherein each rail comprises two rows of balls at both sides of the rail for engaging with the first sliding member and the second sliding member respectively, so that the second sliding member can slide along the first sliding member.

15. The LED display panel, as recited in claim 14, wherein the sliding assembly further comprises a shaft rotatably connecting the second sliding member and the second connection member, so that the second sliding member and the second connection member can rotate relative to each other around the shaft.

16. The LED display panel, as recited in claim 15, wherein the second sliding member further comprises a positioning device extending from a side thereof for retaining the second sliding member on the openable door to a predetermined extend when being pulled away from the housing.

17. The LED display panel, as recited in claim 16, wherein a length of the first sliding member is ranging from 10 cm to 20 cm.

18. The LED display panel, as recited in claim 17, wherein a rotation angle of the openable front door is ranging from 75 to 125 degree.

* * * * *